US006392312B1

(12) United States Patent
Morris

(10) Patent No.: US 6,392,312 B1
(45) Date of Patent: May 21, 2002

(54) PORTABLE ELECTRIC POWER GENERATOR WITH REMOTE CONTROL AND SAFETY APPARATUS

(76) Inventor: Gary Jay Morris, 2026 Glenmark Ave., Morgantown, WV (US) 26505

( * ) Notice: Subject to any disclaimer, the term of this patent is extended or adjusted under 35 U.S.C. 154(b) by 64 days.

(21) Appl. No.: 09/696,515

(22) Filed: Oct. 25, 2000

Related U.S. Application Data

(60) Provisional application No. 60/161,583, filed on Oct. 26, 1999.

(51) Int. Cl.[7] ..... F02N 11/06

(52) U.S. Cl. ..... 290/40 C; 123/179.2; 180/167

(58) Field of Search ..... 290/40 C, 30 R, 290/31, 38 C, 38 R; 123/179.2, 179.28; 180/167, 271

(56) References Cited

U.S. PATENT DOCUMENTS

| | | | | | |
|---|---|---|---|---|---|
| 2,103,324 | A | | 12/1937 | Down | 116/70 |
| 2,241,589 | A | | 5/1941 | Feldhausen | 340/644 |
| 2,384,135 | A | | 9/1945 | Scherry | 290/30 R |
| 2,400,216 | A | * | 5/1946 | Smith | 290/37 R |
| 2,423,464 | A | * | 7/1947 | Moncrief | 290/37 A |
| 2,444,460 | A | | 7/1948 | Moncrief | 290/37 R |
| 2,648,783 | A | | 8/1953 | Clark | 290/30 R |
| 3,191,050 | A | | 6/1965 | Park | 290/4 R |
| 3,357,417 | A | | 12/1967 | Baumann | 123/179.2 |
| 3,396,811 | A | | 8/1968 | Bowers et al. | 180/167 |
| 3,455,403 | A | | 7/1969 | Hawthorne et al. | 180/167 |
| 3,530,846 | A | | 9/1970 | Bean et al. | 123/179.2 |
| 3,543,302 | A | | 11/1970 | Wolthausen | 123/179.2 |
| 3,577,164 | A | | 5/1971 | Re Baratelli et al. | 290/38 C |
| 3,603,802 | A | | 9/1971 | Petric | 290/37 R |
| 3,788,294 | A | * | 1/1974 | Logan | 123/179.2 |
| 3,793,529 | A | * | 2/1974 | Bucher | 123/179.2 |
| 3,811,049 | A | * | 5/1974 | Hildreth et al. | 290/37 R |
| 3,859,540 | A | | 1/1975 | Welner | 290/38 R |
| 4,080,537 | A | | 3/1978 | Bucher | 290/38 R |
| 4,577,599 | A | | 3/1986 | Chmielewski | 123/179.2 |
| 4,674,454 | A | | 6/1987 | Phairr | 123/179.2 |
| 4,798,082 | A | * | 1/1989 | Fujikawa et al. | 290/51 |
| 4,821,024 | A | | 4/1989 | Bayha | 340/309.15 |
| 4,930,467 | A | | 6/1990 | Masuda | 123/79.29 |
| 5,054,569 | A | | 10/1991 | Scott et al. | 180/167 |
| 5,561,330 | A | * | 10/1996 | Crook | 290/30 R |
| 5,601,058 | A | | 2/1997 | Dyches | 123/179.2 |
| 5,734,255 | A | * | 3/1998 | Thompson et al. | 290/2 |
| 5,765,995 | A | * | 6/1998 | Springer | 123/179.4 |
| 5,794,580 | A | | 8/1998 | Galletti | 123/179.2 |
| 5,936,529 | A | * | 8/1999 | Reisman et al. | 340/539 |
| 5,990,800 | A | * | 11/1999 | Tamaki et al. | 123/179.2 |
| 6,075,459 | A | | 6/2000 | Saarem et al. | 340/825.69 |
| 6,130,486 | A | * | 10/2000 | Shimizu et al. | 290/40 A |
| 6,166,525 | A | * | 12/2000 | Crook | 290/30 B |

FOREIGN PATENT DOCUMENTS

| | | | | |
|---|---|---|---|---|
| JP | 10164759 | A | * 6/1998 | H02J/3/38 |

* cited by examiner

*Primary Examiner*—Joseph Waks

(57) ABSTRACT

The utility of portable electric power generators is enhanced through wireless or hardwired remote controlled starting and stopping of the associated internal combustion engine. The safety of the remote controlled device is enhanced through the use of an audible warning emitted prior to starting of the internal combustion engine. The audible warning consists of a tonal pattern or recorded voice message, or both, to warn persons in close proximity that the engine of the generator system is about to start.

23 Claims, 2 Drawing Sheets

PORTABLE ELECTRIC POWER GENERATOR WITH REMOTE CONTROL AND SAFETY APPARATUS

This application is in reference to U.S. Provisional Patent Application 60/161,583 filed on Oct. 26, 1999.

BACKGROUND FOR THE INVENTION

1. Field of Invention

This invention relates to portable electric power generators that are started or stopped by remote control. A unique safety feature includes the use of audible tonal patterns or a recorded verbal message, or both, to warn persons in close proximity to the portable generator that the engine is about to start.

2. Background

Portable electric power generators have become quite common in modern society finding use in remote construction sites, remote camping sites, and emergency auxiliary power supplies for individual homes. Most of these units are powered by liquid or gaseous fuels such as gasoline, diesel fuel, or propane. The convenience and utility of portable electric power generators may be greatly enhanced through the use of remote control devices such as wireless remote controls or hardwired remote controls to control starting and stopping of the engine powering the generator. An audible alarm or verbal warning messages to indicate that the generator is about to start provides a significant safety feature. Due to excessive noise and the exhaust gas emissions, portable electric power generators are often positioned in remote locations with respect to the site where the electrical power is to be consumed. Remote control of the engine driving the generator eliminates the need for the user to travel to the generator site each time it is desired to turn on or to turn off the engine powering the generator. In remote camping sites, remote construction sites, and other applications, the duty cycle of a portable electric power generator is often highly intermittent and, thus, the use of remote control for starting and stopping the unit affords great convenience and is environmentally sound since the unit is only operated when electric power is needed.

SUMMARY OF THE INVENTION

Described herein is the Portable Electric Power Generator with Remote Control Apparatus which comprises a conventional portable electric power generator well known in the art which is equipped with a remote control system consisting of either wireless or hardwired means so the user can start or stop the engine powering the generator unit without having to physically travel to the generator unit location.

The wireless embodiment of the invention makes use of radio frequency communication, optical communication or sonic communication. A battery powered wireless transmitter located at a remote site with respect to the generator unit is used to transmit signals to the battery-powered receiver located on the generator unit. The user operates the transmitter to turn on the engine of the generator or to turn it off and/or to control the engine speed or power or to control the choke setting of the engine. Both the transmitter and receiver may use electronic signal encoding and decoding, respectively, to control only the generator unit intended and to eliminate wireless signal interference and undesired operation of the generator unit due to spurious wireless signals in the vicinity.

The hardwired embodiment of the invention remotely controls the starting and stopping and/or engine speed, choke setting, or power level of the engine powering the portable electric power generator via a set of electrical conductors connected to switches in the remote control unit. These conductors may be manufactured into the extension power cord that must be used to transfer electrical power from the generator to the location where the power is needed, or the control conductors may be a separate set to allow flexibility in the use of various extension power cords.

For both the wireless remote embodiment and the hardwired remote embodiment, the electric power generator is equipped to emit an audible tonal pattern or electronically recorded voice message or both to provide a warning that the internal combustion engine of the generator unit is about to start. A short duration time delay (few seconds) is designed into the system to provide time for the audible alarm or recorded voice warning message, or both, to sound and for personnel to stand clear prior to engaging the starter motor of the internal combustion engine via a remote control command.

Both the wireless remote embodiment and the hardwired remote embodiment of the invention may be manufactured into the generator unit or provided as an accessory to be added on to generator units equipped with an electric start feature.

DETAILED DESCRIPTION OF THE PREFERRED EMBODIMENT

The Portable Power Generator with Remote Control and Safety Apparatus is shown in FIG. 1 as the wireless embodiment of the invention. The word "wireless" means radio frequency, optical, or sonic communication. Use of the word "Radio" is meant to convey all means of wireless communication mentioned above and in no way is intended to limit the scope of the invention to radio frequency communication. When it is desired by the user to remotely start the internal combustion engine 130 to drive the attached electric power generator 140 to produce electrical power, the remote control switches 50 for activating the engine start or stop commands via the wireless transmitter 60 are activated to start the engine 130 located at a remote location with respect to the transmitter 60. The remote control switches 50 are electrically connected to the battery powered electronic encoder and wireless transmitter 60 which electronically encodes the wireless transmitted signal so the wireless receiver and decoder 100 may respond to the proper desired command as transmitted. The encoding and decoding of the wireless signal also permits rejection of spurious electronic noise and affords distinctive addressing between the transmitter and receiver units to avoid interference with other wireless appliances operating in the vicinity. The transmitter unit 60 and receiver unit 100 provide access for the user to select distinctive address codes through the use of DIP switches or terminal jumpers (not shown). Upon the reception of a properly encoded wireless signal emitted by the transmitter 60 intended to start the engine 130, the receiver and decoder unit 100 decodes the signal and electronically activates the electric starter start/stop switch 110 to start the engine 130 via the electric starter 120, which is powered by a storage battery 125. An audible warning output transducer 127 provides an audible tonal pattern or recorded voice message, or both, to serve as a warning that the engine 130 is about to start. An example of such an audible warning is "Beep---Beep---Beep---Caution Engine Generator Starting---Beep---Beep---Beep". This audible warning is completed before the electric starter 120 is engaged; the timing of which is controlled by the receiver and decoder unit 100. Not shown in the drawing is an electronic medium (such as an EEPROM semiconductor chip) that can be programmed from the factory to provide alarm tones and a verbal warning message. The electronic start/stop control switch 110 may consist of an electromechanical relay in one embodiment. Once the engine 130 has started, the electric power generator 140 produces electrical power. When it is desired by the user to remotely stop the internal combustion engine 130 driving the attached electric power generator 140 to produce electrical power, the remote control switches 50 for activating the engine start or stop commands via the wireless transmitter 60 are activated to stop the engine 130 located at a remote location with respect to the transmitter 60. Upon the reception of a properly encoded wireless signal emitted by the transmitter 60 intended to stop the engine 130, the receiver and decoder unit 100 decodes the signal and electronically activates the electric starter start/stop switch 110 to stop the engine 130 via an interruption in the electrical ignition system of the engine 130 or an interruption of fuel flow to the engine 130. The transmitter unit 60 is normally powered by disposable or rechargeable batteries. The receiver unit 100 is normally powered by the storage battery 125 used to power the electric starter 120.

The Portable Electric Power Generator with Remote Control and Safety Apparatus is shown in FIG. 2 as the hardwired embodiment of the invention. When it is desired by the user to start the internal combustion engine 240 to drive the attached electric power generator 250 to produce electrical power, the remote control switches 220 are activated to engage the electric starter 230 via the hardwired electrical conductor set 210 and the electric start/stop control switch 200. Once the engine 240 has started, the electric power generator 250 produces electrical power. When it is desired by the user to stop the internal combustion engine 240, which drives the attached electric power generator 250, the remote control buttons 220 are activated to interrupt the electrical ignition system of the engine 240 or to interrupt the fuel flow to the engine 240. The hardwired electrical conductor set 210 may be an independent set of electrical conductors to control the starting and stopping of the portable electric power generator, or the hardwired electrical conductor set 210 may be included in with the extension power cord that is used to transfer electrical power from the electric power generator 250 to the remote location where the power is needed by the user. An audible warning output transducer 237 provides an audible tonal pattern or recorded voice message, or both, to serve as a warning that the engine 240 is about to start prior. An example of such an audible warning is "Beep---Beep---Beep---Caution Engine Generator Starting---Beep---Beep---Beep". This audible warning is completed before the electric starter 230 is engaged; the timing of which is controlled by the electric start/stop control switch 200. Not shown in the drawing is an electronic medium (such as an EEPROM semiconductor chip) that can be programmed from the factory to provide alarm tones and a verbal warning message.

In another hardwired embodiment (not shown) in order to remotely control the operation of the engine 240, an electrical signal may be transmitted from the remote control unit 220 over the conductors in the extension cord (not shown) which also transfers the electrical power from the generator 250 to the location where the power is needed. Transmission of data over conductors carrying current loads is well known in the art.

In both the wireless and hardwired embodiments of the invention, local controls on the generator unit may also be provided for starting, stopping, and otherwise controlling the operation of the internal combustion engine powering the electric power generator. In addition, a manual recoil starter may be included in both embodiments of the invention.

The various preferred embodiments described above are merely descriptive of the present invention and are in no way intended to limit the scope of the invention. Modifications of the present invention will become obvious to those skilled in the art in light of the detailed description above, and such modifications are intended to fall within the scope of the appended claims.

Figure 1:
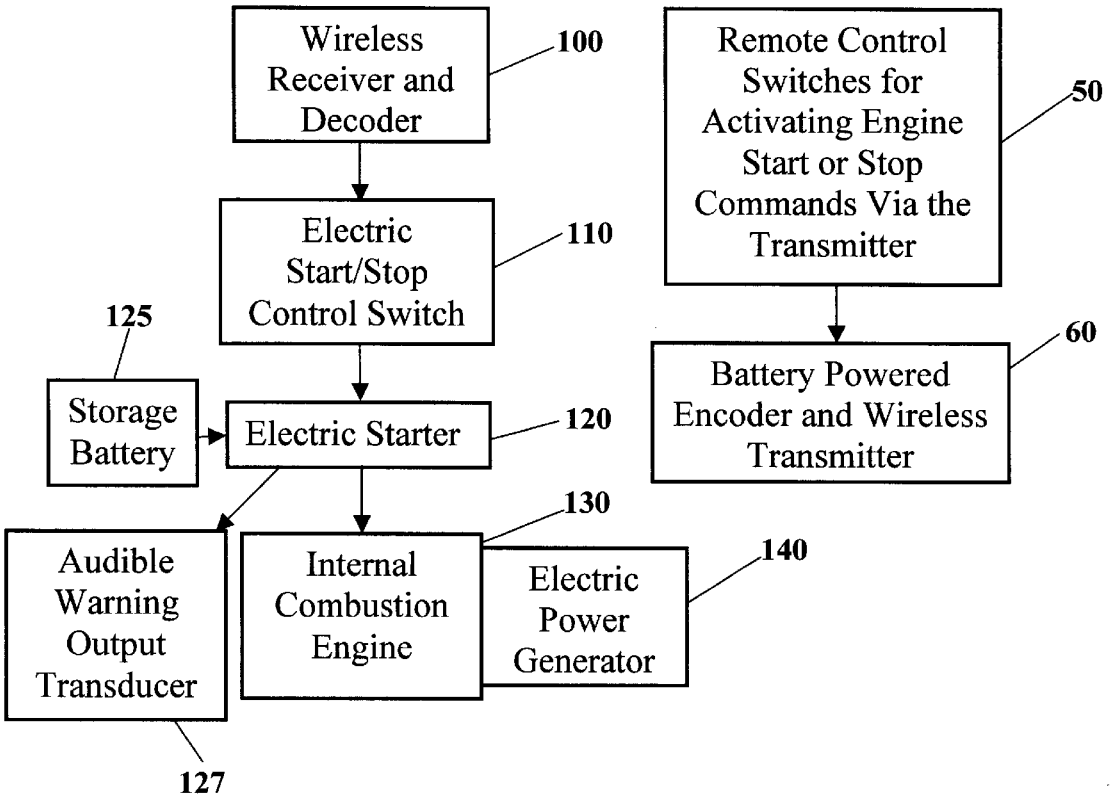
FIG. 1 is a block diagram of the wireless remote controlled embodiment of the Portable Electric Power Generator with Remote Control and Safety Apparatus.
Figure 2:
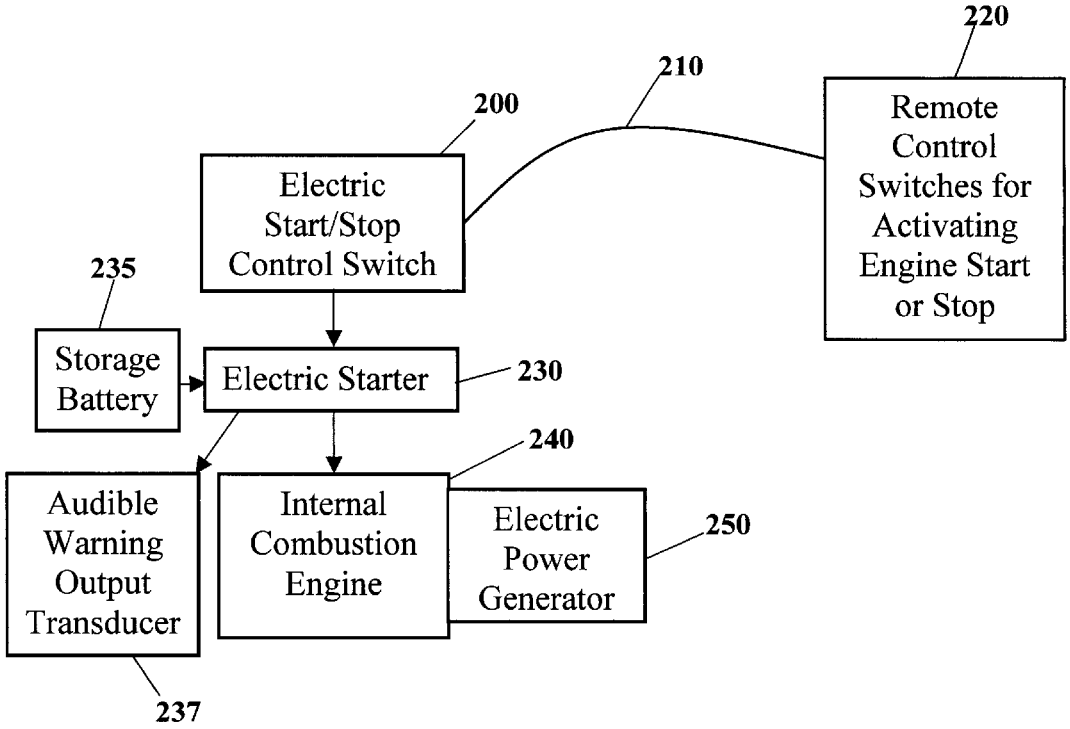
FIG. 2 is a block diagram of the hardwired remote controlled embodiment of the Portable Electric Power Generator with Remote Control and Safety Apparatus.

What is claimed:

1. A portable electric power generator with remote control and safety apparatus comprising:

at least one electric power generator driven by a rotating shaft to produce electrical power, an internal combustion engine to drive the electric power generator, an electric starter for the internal combustion engine complete with a battery power supply to power the electric starter, a battery powered electronic wireless receiver circuit to receive and electronically decode a wireless signal transmitted from a remote location to remotely control the operation of the internal combustion engine, a free standing transportable frame structure securely mounting the at least one electric power generator, the internal combustion engine, the electric starter, the battery powered electronic wireless receiver circuit, and the battery power supply, at least one battery powered wireless transmitter circuit for electrically encoding and transmitting a signal to the remotely located wireless receiver circuit such that said signal includes user selected electronic commands to start or stop the operation of the internal combustion engine driving the electric power generator, the wireless receiver circuit attached to the electric power generator and physically separated from the wireless transmitter circuit, the wireless receiver circuit controls an electronic circuit to emit an audible warning comprising a tonal pattern or electronically recorded voice message, or both, to warn persons in close proximity that the internal combustion engine is about to start such that the audible warning is emitted prior to activation of the electric starter for the internal combustion engine.

2. The apparatus of claim 1 wherein the electrical power generated by the electric power generator consists of alternating current power.

3. The apparatus of claim 1 wherein the electrical power generated by the electric power generator consists of direct current power.

4. The apparatus of claim 1 wherein the internal combustion engine operates on a fuel selected from the group consisting of gasoline, diesel fuel, fuel oil, propane, liquefied petroleum, and natural gas.

5. The apparatus of claim 1 wherein the transmitter circuit and receiver circuit have user-selectable digital addresses to avoid interference with other similar wireless units operating in close proximity.

6. The apparatus of claim 1 wherein the internal combustion engine is equipped with a conventional recoil manual starter.

7. The apparatus of claim 1 wherein the electric starter is equipped with local controls to operate the internal combustion engine.

8. The apparatus of claim 1 wherein the electronically recorded voice message consists of user selectable language types.

9. A portable electric power generator with remote control and safety apparatus comprising:

at least one electric power generator driven by a rotating shaft to produce electrical power, an internal combustion engine to drive the electrical power generating means, an electric starter for the internal combustion engine complete with a battery power supply to power the electric starter, a free standing transportable frame structure securely mounting the at least one electric power generator, the internal combustion engine, the electric starter, and the battery power supply, at least one hardwired remote control with electrical switches for the user to control the starting and stopping or other operating parameters of the the internal combustion engine driving the electric power generator from a remote location in relation to the portable electric power generator location, an electronic control unit on the electric power generator to control an electronic circuit to emit an audible alarm comprising a tonal pattern or electronically recorded voice message, or both, to warn those nearby that the internal combustion engine is about to start such that the audible warning is emitted prior to activation of the electric starter for the internal combustion engine.

10. The apparatus of claim 9 wherein the electrical power generated by the electric power generator consists of alternating current power.

11. The apparatus of claim 9 wherein the electrical power generated by the electric power generator consists of direct current power.

12. The apparatus of claim 9 wherein the internal combustion engine operates on a fuel selected from the group consisting of gasoline, diesel fuel, fuel oil, propane, liquefied petroleum, and natural gas.

13. The apparatus of claim 9 wherein the internal combustion engine is equipped with a conventional recoil manual starter.

14. The apparatus of claim 9 wherein the electric starter is equipped with local controls to operate the internal combustion engine.

15. The apparatus of claim 9 wherein the electronically recorded voice message consists of user selectable language types.

16. A portable electric power generator comprising:

at least one electric power generator driven by a rotating shaft to produce electrical power, an internal combustion engine to drive the electric power generator, an electric starter for the internal combustion engine, a battery power supply to power the electric starter, a battery powered electronic wireless receiver circuit to receive and electronically decode a wireless signal transmitted from a remote location to remotely control the operation of the internal combustion engine, at least one battery powered wireless transmitter circuit for electrically encoding and transmitting a signal to the remotely located wireless receiver circuit such that said signal includes user selected electronic commands to start or stop the operation of the internal combustion engine driving the electric power generator, the wireless receiver circuit controls an electronic circuit to emit an audible warning comprising a tonal pattern or a factory recorded electronic voice message, or both, to warn persons in close proximity that the internal combustion engine is about to start such that the audible warning is emitted prior to activation of the electric starter for the internal combustion engine.

17. The apparatus of claim 16 wherein the electrical power generated by the electric power generator consists of alternating current power.

18. The apparatus of claim 16 wherein the electrical power generated by the electric power generator consists of direct current power.

19. The apparatus of claim 16 wherein the internal combustion engine operates on a fuel selected from the group consisting of gasoline, diesel fuel, fuel oil, propane, liquefied petroleum, and natural gas.

20. The apparatus of claim 16 wherein the factory recorded electronic voice message consists of user selectable language types.

21. A portable apparatus for generating electric power comprising:

at least one electric power generator, an internal combustion engine to drive the at least one electric power generator, an electric starter for the internal combustion engine complete with a battery power supply to power the electric starter and electronic circuits of the electric power generator, at least one remote control means to remotely start the internal combustion engine, an electric control switch linked to the electric power generator to control an electronic circuit to emit an audible warning comprising a tonal pattern or electronically recorded voice message, or both, such that the audible warning is emitted prior to remote activation of the electric starter for the internal combustion engine.

22. The apparatus of claim 21 wherein the remote control means comprises a hardwired electrical connection between the electric control switch and an electrical circuit at a remote location to control the starting of the generator.

23. The apparatus of claim 21 wherein the remote control means comprises a wireless connection between the electric control switch and an electrical circuit at a remote location to control the starting of the generator.

* * * * *